US007311201B2

(12) United States Patent
Lo

(10) Patent No.: US 7,311,201 B2
(45) Date of Patent: Dec. 25, 2007

(54) PACKING CONTAINER FOR A BOTTLED COMMODITY

(76) Inventor: Yueh-Chun Lo, 1F., No.8, Alley 2, Lane 13, Kung Wuu Road, Wu Lin Tsuen, Long-Tarn Shiang, Taoyan Hsien (TW)

( * ) Notice: Subject to any disclaimer, the term of this patent is extended or adjusted under 35 U.S.C. 154(b) by 489 days.

(21) Appl. No.: 10/872,425

(22) Filed: Jun. 22, 2004

(65) Prior Publication Data

US 2005/0279665 A1 Dec. 22, 2005

(51) Int. Cl.
*B65D 85/30* (2006.01)

(52) U.S. Cl. ..... 206/446; 206/427; 206/521

(58) Field of Classification Search ..... 206/3, 206/446, 430, 588, 427, 521; 229/89, 90
See application file for complete search history.

(56) References Cited

U.S. PATENT DOCUMENTS 1,148,115 A * 7/1915 Morton ..... 229/90
1,619,727 A * 3/1927 Hill ..... 206/232
2,148,176 A * 2/1939 Schroeder ..... 428/182
2,458,737 A * 1/1949 Salkowitz ..... 229/90
3,000,492 A * 9/1961 Miller ..... 206/446
3,712,462 A * 1/1973 Gabor et al. ..... 206/217
5,005,759 A * 4/1991 Bouche ..... 229/125.26
5,213,215 A * 5/1993 Prevot ..... 206/588
5,690,246 A * 11/1997 Anderson et al. ..... 220/254.7

* cited by examiner

*Primary Examiner*—David T. Fidei
(74) *Attorney, Agent, or Firm*—Bacon & Thomas, PLLC

(57) ABSTRACT

The packing container for a bottled commodity is made a hollow cylinder with a cylindrical cover, both made from papers; the hollow area is for receiving the bottled commodity, the container especially suits containing a bottled liquid commodity such as wine, bubbled beverage etc. Wherein the bottom of the hollow cylinder has an inner flange with a predetermined height, the bottom of a glass bottle is braced at such predetermined height to prevent undue impact against the bottom of the glass bottle. And the cylindrical cover includes a sleeve having a lower area defining a protruding section to contact the shoulder of the glass bottle and position the bottle; thereby better protection as well as long-term preservation can be provided. The temperature of the bottled liquid can be kept for a long term, and an effect of heat preservation is obtained.

12 Claims, 8 Drawing Sheets

PACKING CONTAINER FOR A BOTTLED COMMODITY

BACKGROUND OF THE INVENTION

1. Field of the Invention

The present invention is related to a packing container for a bottled commodity, and especially to a packing container suiting containing a bottled liquid commodity such as wine, bubbled beverage etc.; the container can provide better protection as well as long-term preservation for the bottled commodity; and the bottled commodity can effectively keep its temperature after refrigeration or heating.

2. Description of the Prior Art

A normal bottled liquid commodity such as wine, bubbled beverage and edible oil etc. mostly is given a glass bottle as its container to prolong its period of preservation and assure stability of the quality of the bottled liquid commodity. Therefore, many bottled liquid commodities are packed each with an additional packing box (or packing can) to enhance the feeling of quality of the commodities, and to give the bottles suitable protection. By all means, some liquid commodities being given containers like ceramic or plastic bottles are also packed with packing boxes (or packing cans).

As shown in FIG. 1 which is a schematic view showing a paper-box structure often seen to pack a glass bottle, a ceramic bottle or a plastic bottle (they are represented by the glass bottle hereinafter), the paper box 10 mainly is used to provide a simple protecting function for the glass bottle 20 by encircling of the folded paper, i.e., by the separation between the paper box 10 and the bottle body, external impact can be suitably buffered. And more, there are positioning sheets 11 in the paper box 10 or in an opening; both the positioning sheets 11 have positioning holes 12 to frame the glass bottle 20 from shaking in the paper box 10.

However basically, the bottom of the glass bottle 20 still is directly abutted against the bottom of the paper box 10, it is probable that the bottom of the glass bottle 20 will be directly impacted to break in case the packed glass bottle 20 is subjected to an undue force when it is placed.

Moreover, when the glass bottle is opened, the packing paper box has no function on the packed glass bottle; the glass bottle now is exposed to the normal temperature (room temperature), by the heat transfer between the glass bottle and the outside temperature, the temperature of the interior liquid commodity will be raised or lowered. If the liquid commodity is wine, this may affect the flavor of the wine; for example, red grape wine is preserved under a better preservation temperature, but its temperature will be raised or lowered when its bottle is opened to expose to the room temperature, and this may affect the flavor of the wine.

SUMMARY OF THE INVENTION

The packing container for a bottled commodity of the present invention is made a hollow cylinder, a cylindrical cover and a sleeve, all of which are made from paper; its hollow area is for receiving a bottled commodity. Wherein the bottom of the hollow cylinder has an inner flange with a predetermined height, the bottom of a glass bottle is braced at such predetermined height to prevent undue impact against the bottom of the glass bottle.

And the cylindrical cover is slipped onto the sleeve which has at a lower area disposed within the cylinder, a bottom inner edge of the sleeve has a protruding section able to contact the shoulder of the glass bottle to position the bottle; thereby providing better protection as well as long-term preservation for the bottle.

Moreover, the cylindrical cover can be provided at the bottom thereof by slipping-in with a sleeve having the aforesaid protruding section, and by slipping of the sleeve in the hollow cylinder, the sleeve can be drawn out after the glass bottle is opened, and then the sleeve can be turned upside down and slipped in the hollow cylinder again to allow revealing of the neck of the glass bottle; thereby the paper walls of the cylinder and the sleeve can make heat transfer with the outside, while air convection at the periphery of the glass bottle is blocked, this can keep the temperature of the bottled liquid commodity for a long term; especially when the liquid commodity is wine, its flavor is more able to preserve.

The present invention will be apparent in its structural construction and entire mode of operation after reading the detailed description of the preferred embodiment thereof in reference to the accompanying drawings.

DETAILED DESCRIPTION OF THE PREFERRED EMBODIMENT

Figure 1:
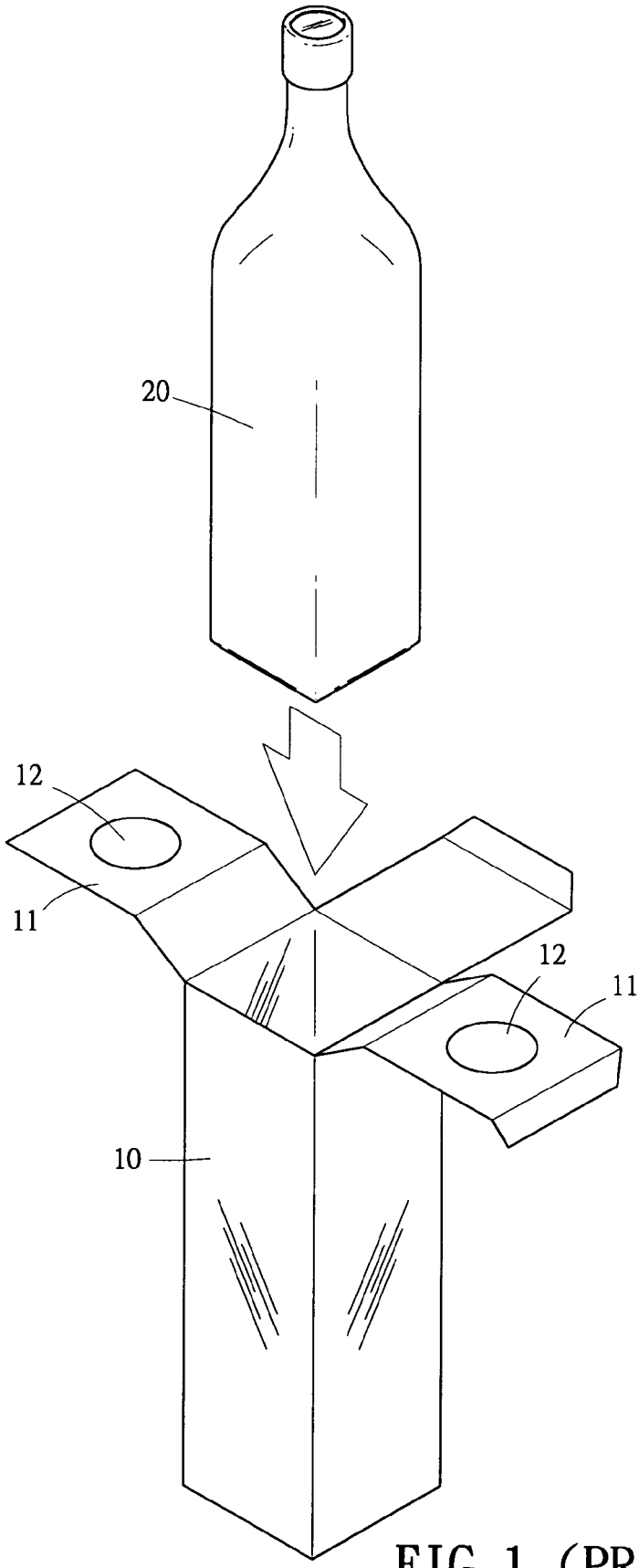
FIG. 1 (PRIOR ART)
FIG. 1 is a perspective schematic view showing the structure of a paper box for a conventional bottled commodity.
Figure 2:
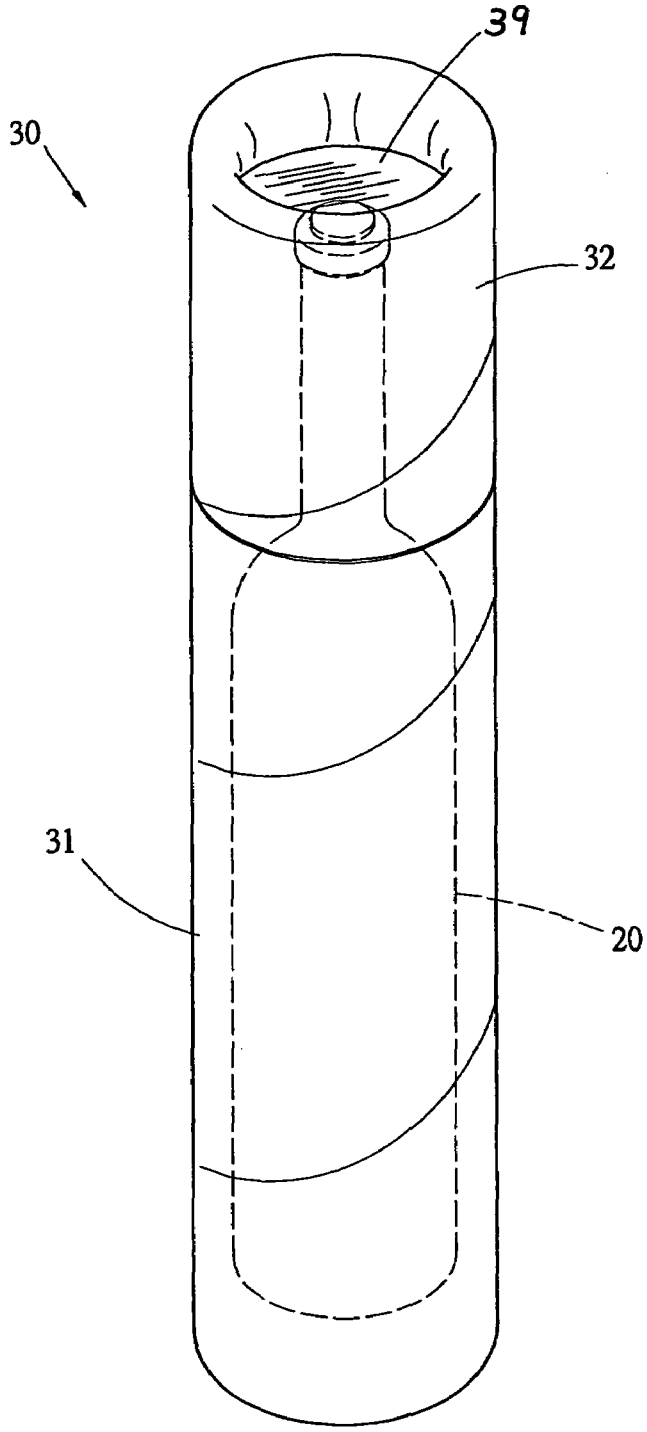
FIG. 2 is a perspective view showing the appearance of a first embodiment of packing cylindrical paper container of the present invention.
Figure 3:
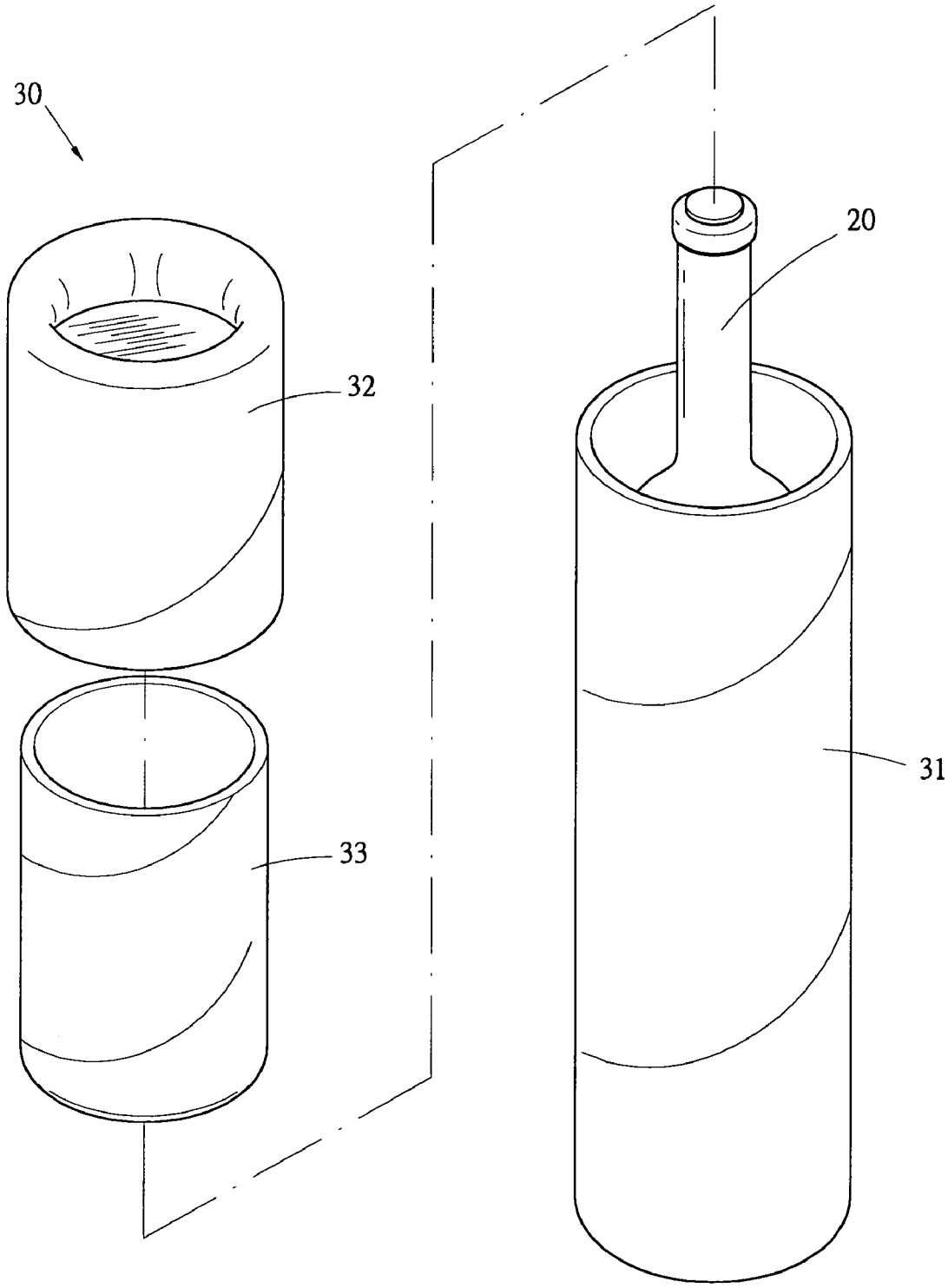
FIG. 3 is an analytic perspective view of the first embodiment of packing cylindrical paper container of the present invention.

As to the packing container for a bottled commodity of the present invention, the structural construction and the way of use of the entire packing cylindrical paper container are as shown in FIGS. 2, 3, the packing cylindrical paper container 30 comprises a hollow cylinder 31, a cylindrical cover 32 and a sleeve 33 (slipping in the former two for connection) all made from papers; wherein a hollow area is for receiving a glass bottle 20, a ceramic bottle or a plastic bottle (they are represented by the glass bottle hereinafter).

In practicing, the hollow cylinder 31, the cylindrical cover 32 and the sleeve 33 are made by folding and curling of multi-layer papers, this not only can increase the feeling of quality of the commodity, but also can adequately prevent impact against the glass bottle 20, and can have a real effect of environment conservation.

Figure 4:
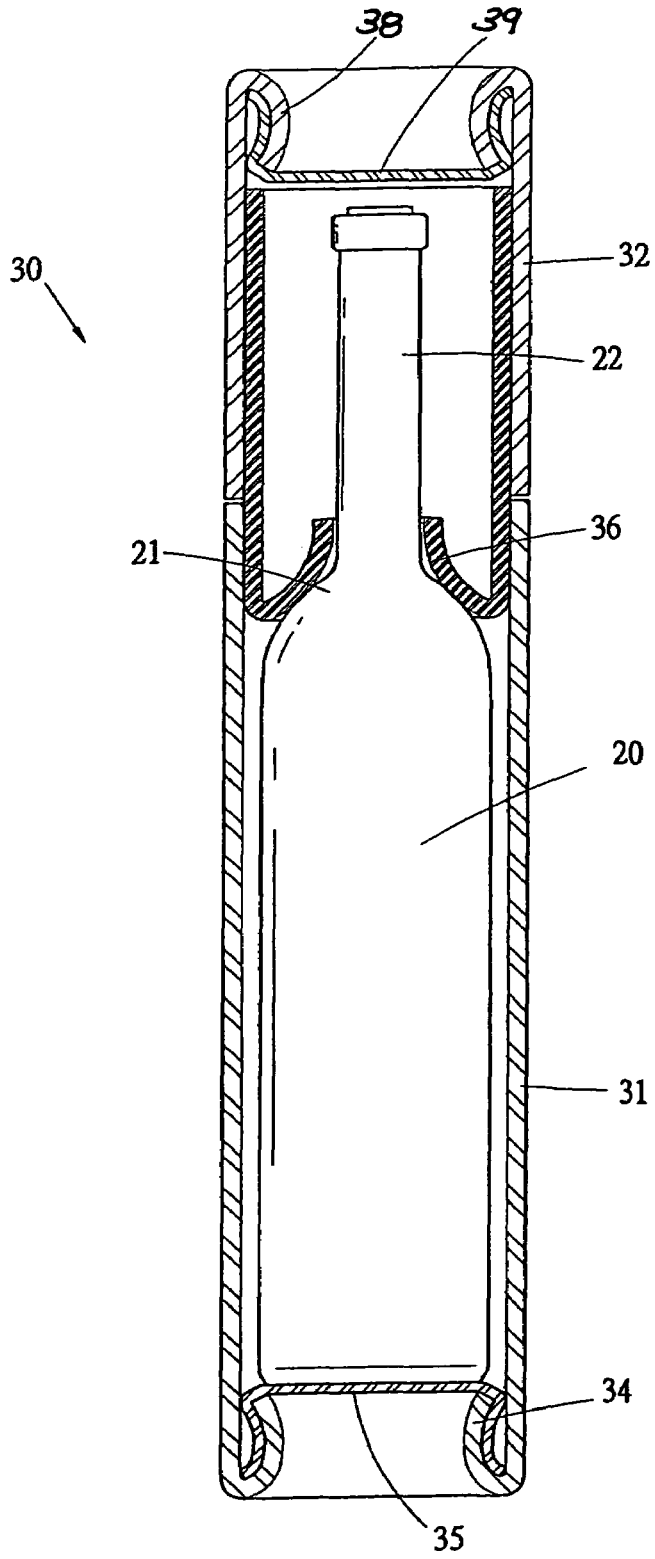
FIG. 4 is a sectional view of the first embodiment of packing cylindrical paper container of the present invention.

Referring to FIG. 4 in which the bottom of the cylinder 31 has an inner flange 34, in this embodiment, the inner flange 34 is formed directly by folding and curling of the bottom edge of the cylinder 31 inwardly of the cylinder 31 to make the inner flange 34 extend a predetermined height inside of the cylinder 31; the inner flange 34 and the cylinder 31 are provided therebetween with a sealing lid 35 to seal the bottom of the cylinder 31.

Therefore, when the glass bottle 20 is placed in the cylinder 31, the inner flange 34 braces the bottom of the glass bottle 20 at such predetermined height to prevent undue impact against the bottom of the glass bottle 20.

And more, as shown in the drawing, the cylindrical cover 32 has a lower area engageable with an upper edge of cylinder 31, a bottom inner edge of sleeve 33 has an inwardly protruding section 36 able to contact the shoulder 21 of the glass bottle. In practical performance, the sleeve 33 extends below the bottom inner edge of the cylindrical cover 32, the bottom of the sleeve 33 is slipped in from the upper end of the cylinder 31 to form a slipping connection of the cylindrical cover 32 with the cylinder 31. The bottom edge of the sleeve 33 is folded inwardly to form protruding section 36 which fixes the glass bottle 20 contacting a shoulder 21 of the glass bottle 20, and prevents the glass bottle 20 from shaking in the cylindrical paper container 30.

Figure 5:
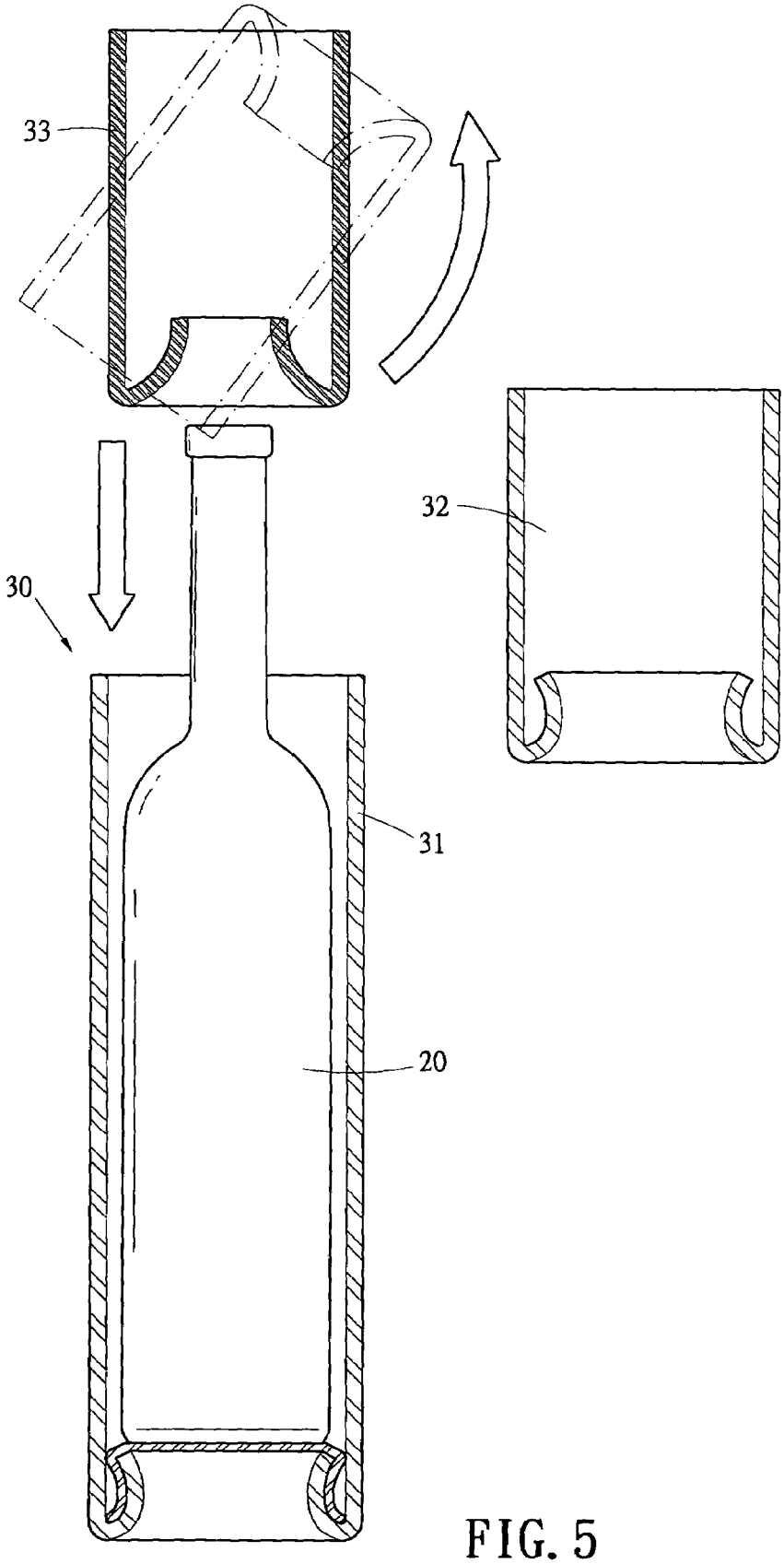
FIG. 5 is a schematic sectional view showing an action of drawing/turning upside down of a sleeve of the present invention.
Figure 6:
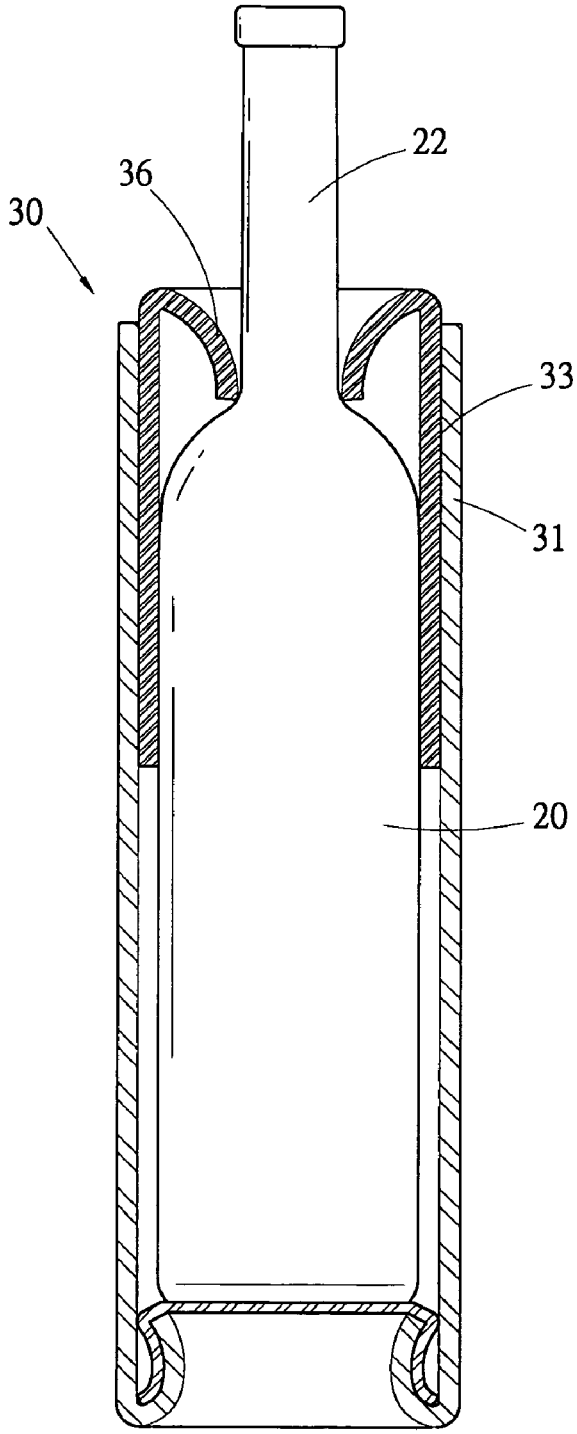
FIG. 6 is a sectional view showing the state of reverse slipping-in of the cylinder of the present invention in use.

Particularly, after the glass bottle 20 has been opened, as shown in FIGS. 5 and 6, the cylindrical cover 32 can be separated from the sleeve 33, then the sleeve 33 can be drawn out of the top of the cylinder 31 and can be turned upside down and slipped in the cylinder 31 again, the protruding section 36 obscures the opened area between the glass bottle 20 and the cylinder 31 and only allow revealing of the neck 22 of the glass bottle 20; thereby the paper walls of the cylinder 31 and the sleeve 33 can cut off the heat transfer of the glass bottle 20 with the outside, and can cut off the air convection at the periphery of the glass bottle, and thus keep the temperature of wine for a long term.

Further as shown in FIG. 4, the entire cylindrical paper container 30 has the top edge of its cylindrical cover 32 folded and curled to form another inner flange 30, this not only can increase the good appearance of the cylindrical cover 32, and can prevent the paper on the top edge from cocking; and the inner flange 38 and the cylindrical cover 32 are provided therebetween with another sealing lid 39 to seal the top of the cylindrical cover 32.

Figure 7:
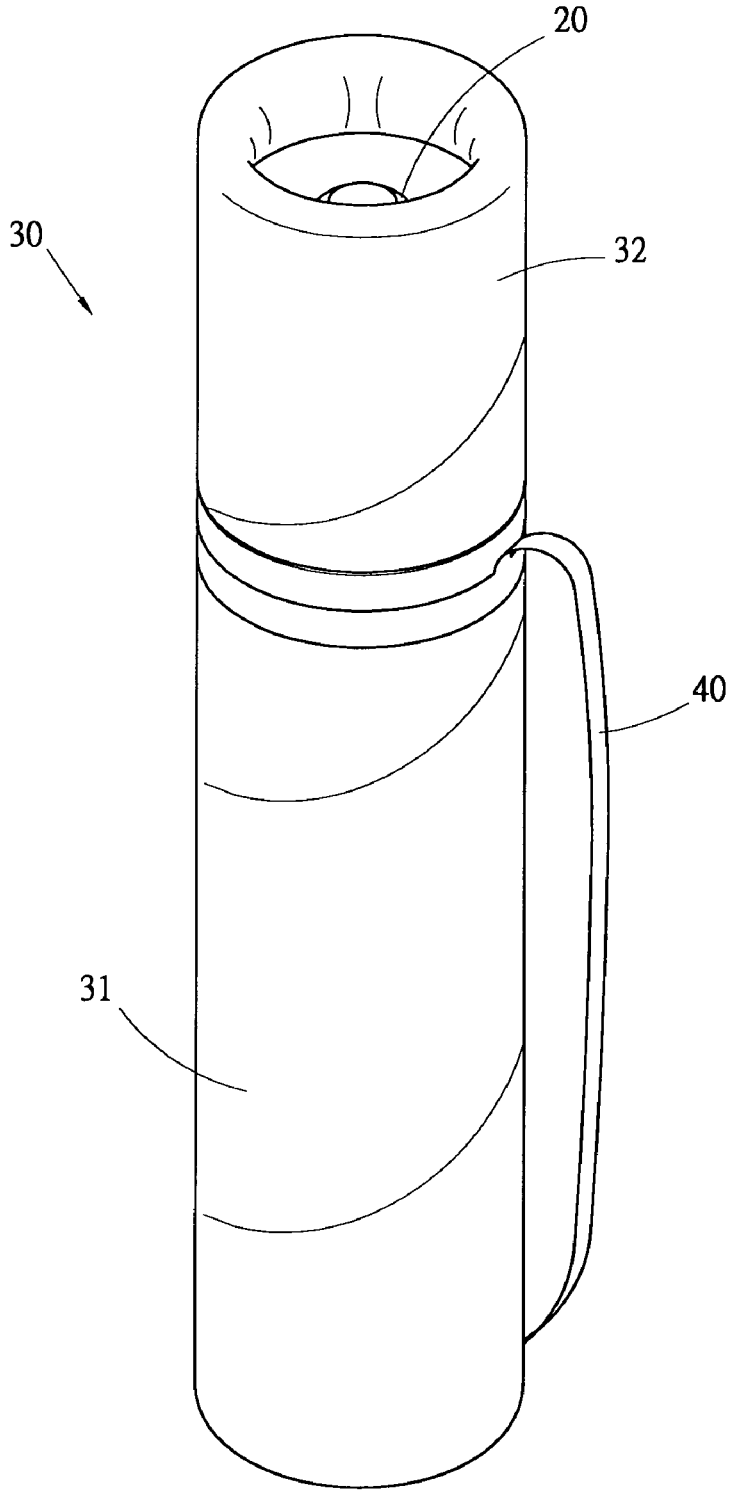
FIG. 7 is a perspective view showing the appearance of a second embodiment of packing cylindrical paper container of the present invention.
Figure 8:
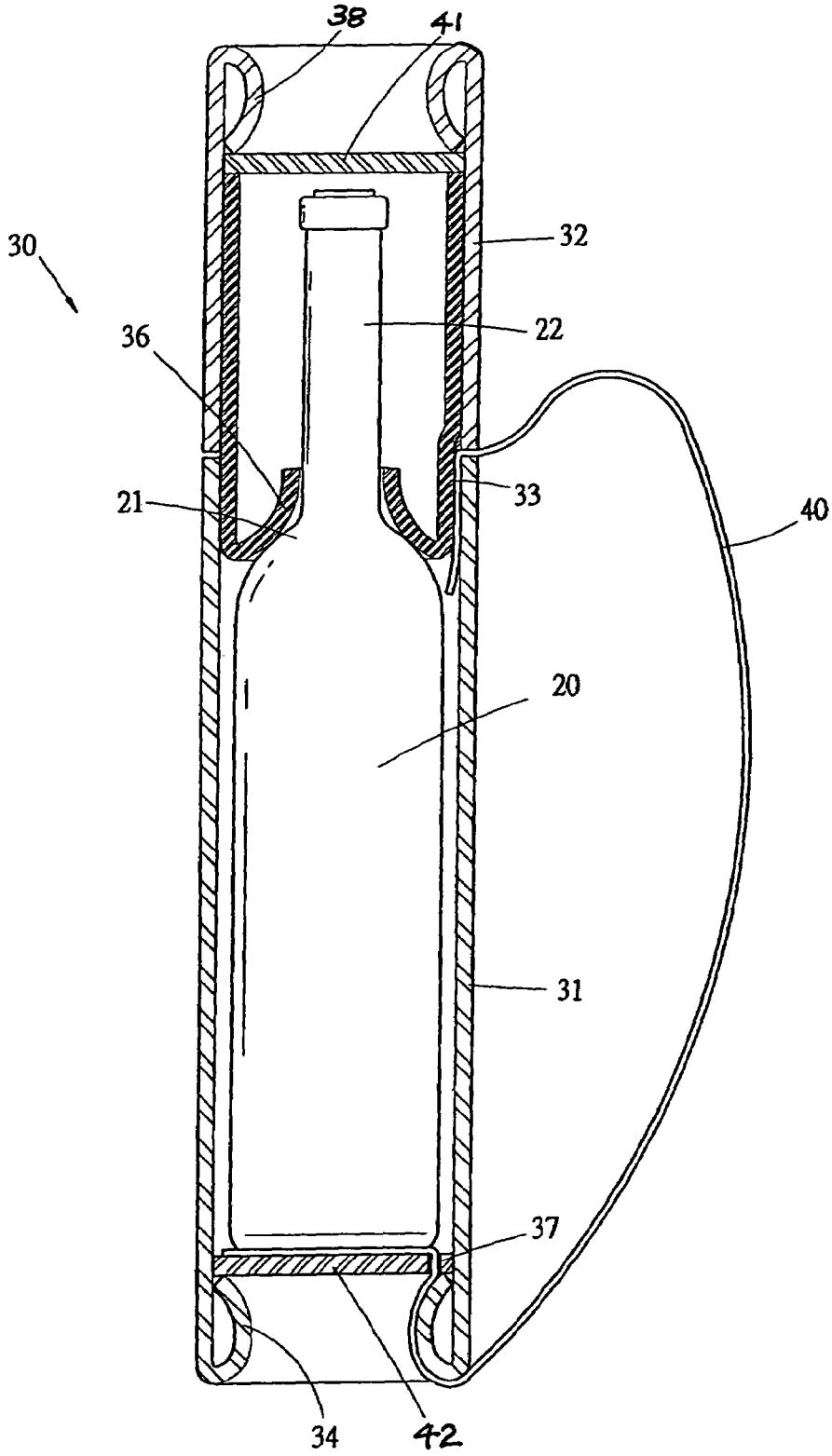
FIG. 8 is a sectional view of a third embodiment of packing cylindrical paper container of the present invention.

Further as shown in FIGS. 7 and 8, another embodiment of the present invention, the entire packing cylindrical paper container 30 has the top of the cylindrical cover 32 and the bottom of the cylinder 31 each being provided with a transparent sealing lid 41 and 42, respectively, in order that during using, a consumer can directly observe through lids 41 and 42 at the top and the bottom respectively of the cylindrical cover 32 and the cylinder 31 to see whether the glass bottle 20 is intact, and to see whether it is the commodity desired to purchase; this can make obvious of the practical function of the entire packing cylindrical paper container 30.

Moreover, the packing cylindrical paper container 30 can be further provided with a holding rope 40 to provide convenience of using the packing cylindrical paper container 30; in the embodiment shown in FIG. 7, the two ends of the holding rope 40 are fixed on areas near to the top of the cylinder 31; certainly, it can also be as shown in FIG. 8 that, one end of the holding rope 40 is extended into the cylinder 31 through a hole 37 provided in the sealing lid 42 and fixed in the cylinder 31; while the other end is extended into the cylinder 31 from an opening formed on the top of the cylinder 31, and it is fixed by clamping between the sleeve 33 and the cylinder 31 (or between the sleeve 33 and the cylindrical cover 32) when slipping the sleeve 33 in the cylinder 31 and the cylindrical cover 32. This forms a handle for conveniently carrying the packing cylindrical paper container 30. And in this embodiment, the sealing lids 42 and 41 can also be provided respectively at the bottom of the cylinder 31 and the top of the cylindrical cover 32 to provide an option whether the bottom of the cylinder 31 or the top of the cylindrical cover 32 is desired to be obscured by a nontransparent lid 42 or 41, respectively.

According to the description disclosed above, the present invention provides a better and practicable structure of a packing cylindrical paper container for the patent application. While the specification and the drawings given are only for illustrating the embodiments of the present invention, and not for giving any limitation to the scope of the present invention; it will be apparent to those skilled in this art that various modifications or changes without departing from the spirit of this invention shall also fall within the scope of the appended claims.

The invention claimed is:

1. A packing container for a bottled commodity, said container comprising a hollow cylinder, a cylindrical cover and a sleeve, all made from papers, said cylinder and said cylindrical cover are mutually connectible by slipping the cylinder and the cylindrical cover onto the sleeve to form a structure for receiving a bottled commodity, a bottom of said hollow cylinder has an inner flange of a predetermined height extending inside of said hollow cylinder, said inner flange provides a stopping action beneath said bottled commodity, and braces said glass bottle at said predetermined height, a lower area of said cylindrical cover is engageable with an upper area of said cylinder, and a bottom inner edge of said sleeve has a protruding section for contacting a shoulder of said glass bottle to position said glass bottle within the container after the cylinder is slipped onto the sleeve.

2. The packing container for a bottled commodity as in claim 1, wherein:

the bottom of said cylinder is made open; and said inner flange of said cylinder is formed directly by folding and curling of a bottom edge of said cylinder inwardly of said cylinder.

3. The packing container for a bottled commodity as in claim 1, wherein:

a top of said cylindrical cover is made open; and a top edge of said cylindrical cover forms an inner flange by folding and curling a top edge of said cylindrical cover inwardly.

4. The packing container for a bottled commodity as in claim 1, wherein:

said bottom of said cylinder has a sealing lid.

5. The packing container for a bottled commodity as in claim 1, wherein:

said inner flange of said cylinder is formed directly by folding and curling of a bottom edge of said cylinder inwardly; said inner flange and said cylinder are provided therebetween with a sealing lid to seal said bottom of said cylinder.

6. The packing container for a bottled commodity as in claim 1, wherein:

a top of said cylindrical cover has a sealing lid.

7. The packing container for a bottled commodity as in claim 1, wherein:

a top edge of said cylindrical cover forms an inner flange by folding and curling a top edge of said cylindrical cover inwardly; said inner flange and said cylindrical cover are provided therebetween with a sealing lid to seal the top of said cylindrical cover.

8. The packing container for a bottled commodity as in claim 1, wherein:

said cylinder is provided with a holding rope.

9. The packing container for a bottled commodity as in claim 1, wherein:

said cylinder is made by folding and curling of multi-layer papers.

10. The packing container for a bottled commodity as in claim 1, wherein:

said cylindrical cover is made by folding and curling of multi-layer papers.

11. The packing container for a bottled commodity as in claim 1, wherein:

said sleeve is adapted for separating from said cylindrical cover, then is adapted for being turned upside down and slipped in said cylinder again, said protruding section of said sleeve obscures an opened area between said glass bottle and said cylinder.

12. The packing container for a bottled commodity as in claim 1, wherein:

said bottom of said cylinder has a sealing lid, said sealing lid is provided with a hole, and said sealing lid is provided with a holding rope on the periphery thereof, one end of said holding rope is extended into said cylinder through said hole provided on said sealing lid and fixed in said cylinder; while the other end of said holding rope is fixed by clamping between said sleeve and said cylinder.

* * * * *